US009745836B2

(12) United States Patent
Zevenbergen et al.

(10) Patent No.: US 9,745,836 B2
(45) Date of Patent: Aug. 29, 2017

(54) TIME DELAYED SECONDARY RETENTION MECHANISM FOR SAFETY JOINT IN A WELLBORE

(75) Inventors: Reid Elliott Zevenbergen, Carrollton, TX (US); Paul David Ringgenberg, Frisco, TX (US); Russell S. Haake, Dallas, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 259 days.

(21) Appl. No.: 14/408,046

(22) PCT Filed: Jul. 25, 2012

(86) PCT No.: PCT/US2012/048029

§ 371 (c)(1),
(2), (4) Date: Dec. 15, 2014

(87) PCT Pub. No.: WO2014/018026

PCT Pub. Date: Jan. 30, 2014

(65) Prior Publication Data

US 2015/0101790 A1 Apr. 16, 2015

(51) Int. Cl.
*E21B 43/11* (2006.01)
*E21B 17/06* (2006.01)
(Continued)

(52) U.S. Cl.
CPC ..... *E21B 43/116* (2013.01); *E21B 17/02* (2013.01); *E21B 17/06* (2013.01)

(58) Field of Classification Search
CPC ..... E21B 17/06; E21B 17/02; E21B 43/116
See application file for complete search history.

(56) References Cited

U.S. PATENT DOCUMENTS 4,564,076 A * 1/1986 Vann ..... E21B 43/11852 166/297
4,971,365 A * 11/1990 Schultz ..... E21B 17/07 166/301
(Continued)

FOREIGN PATENT DOCUMENTS

EP 686753 12/1995
EP 871816 4/2000
(Continued)

OTHER PUBLICATIONS

European Patent Application No. 12881962.0, Extended European Search Report, Jun. 23, 2016, 10 pages.
(Continued)

*Primary Examiner* — Jennifer H Gay
(74) *Attorney, Agent, or Firm* — Kilpatrick Townsend & Stockton LLP

(57) ABSTRACT

Certain aspects and features of the present invention are directed to a safety joint that can be disposed in a wellbore through a fluid-producing formation. The safety joint can include a body configured to be disposed in the wellbore, a primary retention mechanism, a secondary retention mechanism, and a time delay mechanism. The primary retention mechanism can be coupled to the body and can prevent the actuation of the safety joint. The secondary retention mechanism can be coupled to the body and can prevent the actuation of the safety joint in response to the primary retention mechanism allowing the actuation of the safety joint. The time delay mechanism can generate a time delay between the primary retention mechanism allowing the actuation of the safety joint and the secondary retention mechanism preventing the actuation of the safety joint.

18 Claims, 4 Drawing Sheets

(51) Int. Cl.
*E21B 17/02* (2006.01)
*E21B 43/116* (2006.01)

(56) References Cited

U.S. PATENT DOCUMENTS 5,109,921 A 5/1992 Aracena
5,257,663 A 11/1993 Morris et al.
5,568,836 A * 10/1996 Reid ..... E21B 17/023 166/237
6,098,716 A 8/2000 Hromas et al.
6,269,883 B1 * 8/2001 Gissler ..... E21B 17/023 166/241.5
7,431,094 B2 10/2008 De Clute-Melancon
2007/0209803 A1 * 9/2007 De Clute-Melancon ..... E21B 23/006 166/377
2010/0319930 A1 12/2010 Evans
2011/0130966 A1 * 6/2011 Zhan ..... E21B 49/087 702/12
2011/0146988 A1 6/2011 McGlothen et al.
2015/0101790 A1 * 4/2015 Zevenbergen ..... E21B 17/06 166/55.1

FOREIGN PATENT DOCUMENTS

VG GB 2412932 A * 10/2005 ..... E21B 17/06
WO 0116456 3/2001

OTHER PUBLICATIONS

European Patent Application No. 12881962.0 , Office Action, mailed Mar. 31, 2016, 6 pages.
Singapore Patent Application No. SG11201500094R , Written Opinion, mailed Nov. 30, 2015, 4 pages.
Australian Patent Application No. 2012385990; Australian Examination Report issued Oct. 15, 2015; 3 pages.
International Patent Application No. PCT/US2012/048029 , International Search Report and Written Opinion mailed Mar. 22, 2013, 12 pages.
Australian Patent Application No. 2012385990, Examination Report No. 2, mailed Oct. 14, 2016, 3 pages.

* cited by examiner

TIME DELAYED SECONDARY RETENTION MECHANISM FOR SAFETY JOINT IN A WELLBORE

CROSS-REFERENCE TO RELATED APPLICATIONS

This is a U.S. national phase under 35 U.S.C. 371 of International Patent Application No. PCT/US2012/048029, titled "Time Delayed Secondary Retention Mechanism for Safety Joint in a Wellbore" and filed Jul. 25, 2012, the entirety of which is incorporated herein by reference.

TECHNICAL FIELD OF THE INVENTION

The present invention relates generally to devices for deploying tools in a wellbore in a subterranean formation and, more particularly (although not necessarily exclusively), to a safety joint having a time delayed secondary retention mechanism in the wellbore of a producing well.

BACKGROUND

Groups of tools can be deployed as a tool string into the wellbore of a well, such as an oil or gas well for extracting fluids that can include petroleum oil hydrocarbons from a subterranean formation. The tools of the tool string can be used to prepare the well for the production of petroleum oil hydrocarbons or other production fluids. The tools can include, for example, a packer assembly and electronic gauges that are relatively sensitive to shock loading. The tool string can also include a safety joint. The safety joint can allow one or more tools of the tool string to be removed from the wellbore. For example, perforating guns included in the tool string may become stuck following perforation of the tubing string of the well system. A safety joint can allow other tools of the tool string to be decoupled from the perforation guns and retrieved from the wellbore.

Safety joints can include a retention mechanism, such as a set of shear pins. The retention mechanism can prevent a mandrel of a safety joint from fully extending. Previous safety joints may include only a single retention mechanism. Safety joints including only a single retention mechanism can be prematurely released by, for example, a force caused by the firing of perforation guns shearing a set of shear pins. Prematurely releasing the retention mechanism can cause the safety joint to be actuated prematurely by partially or fully extending the mandrel during deployment of the tool string, thereby rendering the safety joint inoperable.

It is desirable to prevent premature actuation of a safety joint caused by the unintentional shearing of the shear pin assembly.

SUMMARY

In one aspect, a safety joint is provided that can be disposed in a wellbore through a fluid-producing formation. The safety joint can include a body configured to be disposed in the wellbore, a primary retention mechanism, a secondary retention mechanism, and a time delay mechanism. The primary retention mechanism and the secondary retention mechanism can be coupled to the body. The primary retention mechanism can prevent actuation of the safety joint and the secondary retention mechanism can prevent actuation of the safety joint in response to the primary retention mechanism allowing actuation of the safety joint. The time delay mechanism can generate a time delay between the primary retention mechanism allowing actuation of the safety joint and the secondary retention mechanism preventing actuation of the safety joint.

In another aspect, a tool string is provided that can be disposed in a wellbore through a fluid-producing formation. The tool string can include a gun assembly and a safety joint. The gun assembly can perforate a tubing string disposed in the wellbore. The safety joint can include a body, a primary retention mechanism, a secondary retention mechanism, and a time delay mechanism. The body can be coupled to the gun assembly. The primary retention mechanism can be coupled to the body. The primary retention mechanism can prevent actuation of the safety joint. The secondary retention mechanism can be coupled to the body. The secondary retention mechanism can prevent the actuation of the safety joint in response to the primary retention mechanism allowing the actuation of the safety joint. The time delay mechanism can generate a time delay between the primary retention mechanism allowing the actuation of the safety joint and the secondary retention mechanism preventing the actuation of the safety joint. The time delay is greater than a duration of a perforating activity by the gun assembly.

In another aspect, a safety joint is provided that can be disposed in a wellbore through a fluid-producing formation. The safety joint can include a body, a first set of shear pins, a second set of shear pins, and a time delay mechanism. The body can be disposed in the wellbore. The first set of shear pins can be coupled to the body. The first set of shear pins can prevent actuation of the safety joint. The second set of shear pins can be coupled to the body. The second set of shear pins can prevent the actuation of the safety joint in response to the first set of shear pins allowing the actuation of the safety joint. The time delay mechanism can generate a time delay between the first set of shear pins allowing the actuation of the safety joint and the second set of shear pins preventing the actuation of the safety joint.

These illustrative aspects and features are mentioned not to limit or define the invention, but to provide examples to aid understanding of the inventive concepts disclosed in this application. Other aspects, advantages, and features of the present invention will become apparent after review of the entire application.

DETAILED DESCRIPTION

Figure 1:
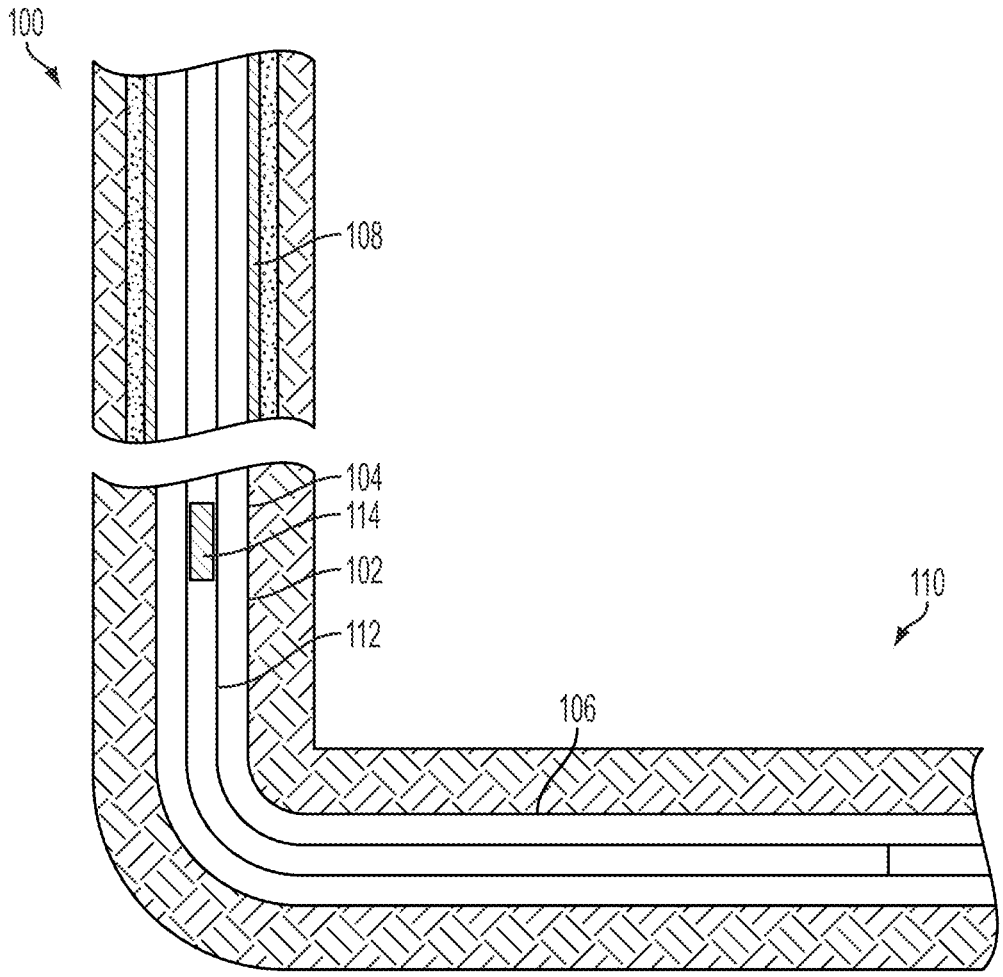
FIG. 1 is a schematic illustration of a well system having a tool string according to one aspect of the present invention.

Certain aspects and features of the present invention are directed to a safety joint with a time delayed secondary retention mechanism disposed in the wellbore of a well system. A safety joint can be included in a string of tools in a wellbore. The safety joint can include a mandrel configured to fully extend upon deploying the safety joint in the wellbore. The mandrel can be an extendable shaft of the safety joint around which other components of the safety joint are arranged or assembled.

A primary retention mechanism, such as a first set of shear pins, can prevent the mandrel from extending during deployment of the safety joint. A force (or "kick") generated by the firing of perforating guns in a wellbore can inadvertently shear the primary retention mechanism in a safety joint. A secondary retention mechanism, such as a second set of shear pins, can prevent the premature or unintentional shearing of a primary retention mechanism from allowing the mandrel to extend fully. A time delay mechanism can generate a time delay between the shearing of the primary retention mechanism and the loading of the secondary retention mechanism. For example, the time delay mechanism can restrict the flow of a metering fluid through the safety joint as the mandrel extends. Restricting the flow of metering fluid can reduce the speed at which the mandrel extends after the shearing of the primary retention mechanism, thereby delaying the time at which the secondary retention mechanism exerts a force resisting the extension of the mandrel. The time delay can be varied by changing the flow rate of the metering fluid through the safety joint.

Including a time delayed secondary retention mechanism can prevent the premature actuation of the safety joint caused by the firing of the perforating guns or other forces causing the inadvertent release of the primary retention mechanism, thereby preventing time consuming and expensive operations to recover a tool string in the wellbore.

These illustrative examples are given to introduce the reader to the general subject matter discussed here and are not intended to limit the scope of the disclosed concepts. The following sections describe various additional aspects and examples with reference to the drawings in which like numerals indicate like elements, and directional descriptions are used to describe the illustrative aspects. The following sections use directional descriptions such as "above," "below," "upper," "lower," "upward," "downward," "left," "right," "uphole," "downhole," etc. in relation to the illustrative aspects as they are depicted in the figures, the upward direction being toward the top of the corresponding figure and the downward direction being toward the bottom of the corresponding figure, the uphole direction being toward the surface of the well and the downhole direction being toward the toe of the well. Like the illustrative aspects, the numerals and directional descriptions included in the following sections should not be used to limit the present invention.

FIG. 1 schematically depicts a well system 100 having a tool string 114. The well system 100 includes a bore that is a wellbore 102 extending through various earth strata. The wellbore 102 has a substantially vertical section 104 and a substantially horizontal section 106. The substantially vertical section 104 and the substantially horizontal section 106 may include a casing string 108 cemented at an upper portion of the substantially vertical section 104. In some aspects, a liner can be disposed within the wellbore 102. A liner can be a casing string that does not extend to the top of the wellbore 102 and is anchored or suspended from inside the bottom of a previous casing string. The substantially horizontal section 106 extends through a hydrocarbon bearing subterranean formation 110.

A tubing string 112 extends from the surface within wellbore 102. The tubing string 112 can provide a conduit for formation fluids, such as production fluids produced from the subterranean formation 110, to travel from the substantially horizontal section 106 to the surface. Pressure from a bore in a subterranean formation can cause formation fluids, such as gas or petroleum, to flow to the surface. The rate of fluid flow can be controlled using one or more inflow control devices.

The tool string 114, depicted as a functional block in FIG. 1, is positioned in the tubing string 112 at a vertical section 104. The tool string 114 can include one or more tools deployed into the tubing string 112. The one or more tools can be coupled to one another. The one or more tools of the tool string 114 can be used to prepare the well system 100 for the production of fluid from the formation 110.

Although FIG. 1 depicts the tool string 114 positioned in the substantially vertical section 104, a tool string can be located, additionally or alternatively, in the substantially horizontal section 106. In some aspects, tool strings can be disposed in simpler wellbores, such as wellbores having only a substantially vertical section. Although FIG. 1 depicts a single tool string 114 positioned in the tubing string 112, any number of tool strings can be used.

Figure 2:
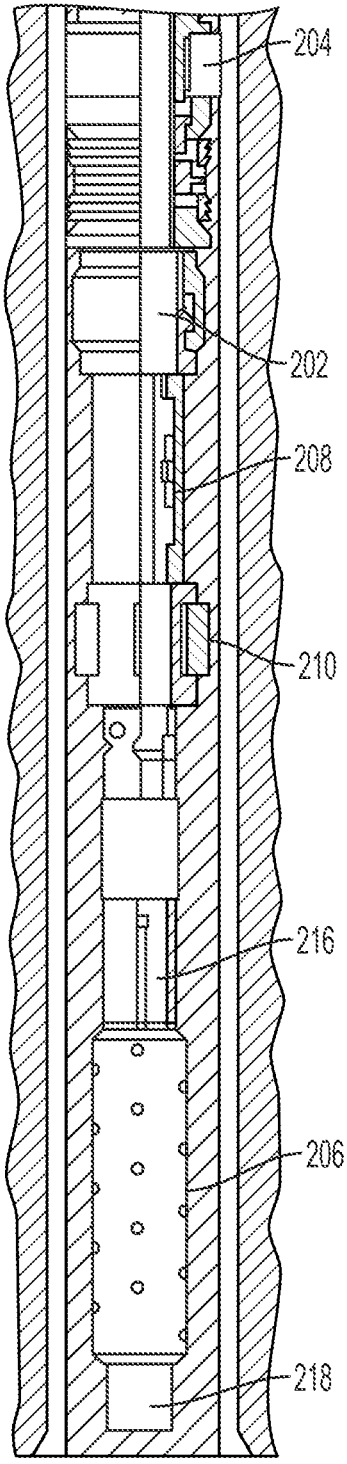
FIG. 2 is a cross-sectional view of a tool string including a safety joint according to one aspect of the present invention.

FIG. 2 is a cross-sectional view of a tool string 114 including a safety joint 202. The tool string 114 can include the safety joint 202, a packer 204, a gun assembly 206, an axial shock absorber 208, a radial shock absorber 210, and a firing head 212.

The packer 204 can be a device for isolating the annulus in the wellbore 102 from a production conduit of the well system 100. A packer 204 can include a mechanism to secure the packer against the casing string 108 of the wellbore 102 and a mechanism to create a reliable hydraulic seal to isolate the annulus, such as an expandable element.

The gun assembly 206 can be a device, such as one or more perforating guns, for perforating the tubing string 112 in preparation for production of fluid from the formation 110. A force applied to the firing head 212 can cause the gun assembly 206 to detonate one or more charges disposed in the gun assembly 206. Detonating the charges can perforate the casing string 108 or a liner disposed in the wellbore 102, thereby allowing the flow of fluid from the formation 110 into the tubing string 112.

The safety joint 202 can be deployed with the tool string 114 in the tubing string 112. The safety joint can allow the packer 204 or other tools included in the tool string 114 to be decoupled from the gun assembly 206. For example, the guns of the gun assembly 206 may become stuck during or after perforation of the tubing string 112. The safety joint 202 can allow other tools of the tool string 114 to be decoupled from the gun assembly 206 and retrieved from the wellbore 102.

The axial shock absorber 208 can protect pressure-measuring equipment or other tools of the tool string 114 from axial shock forces transmitted through the tool string 114 by the firing of gun assembly 206. The radial shock absorber 210 can protect pressure-measuring equipment and other tools of the tool string 114 from radial shock forces transmitted through the tool string 114 by the firing of gun assembly 206.

Additional or alternative aspects of the tool string 114 can omit one or more of the axial shock absorber 208, the radial shock absorber 210, or the firing head 212.

Figure 3:
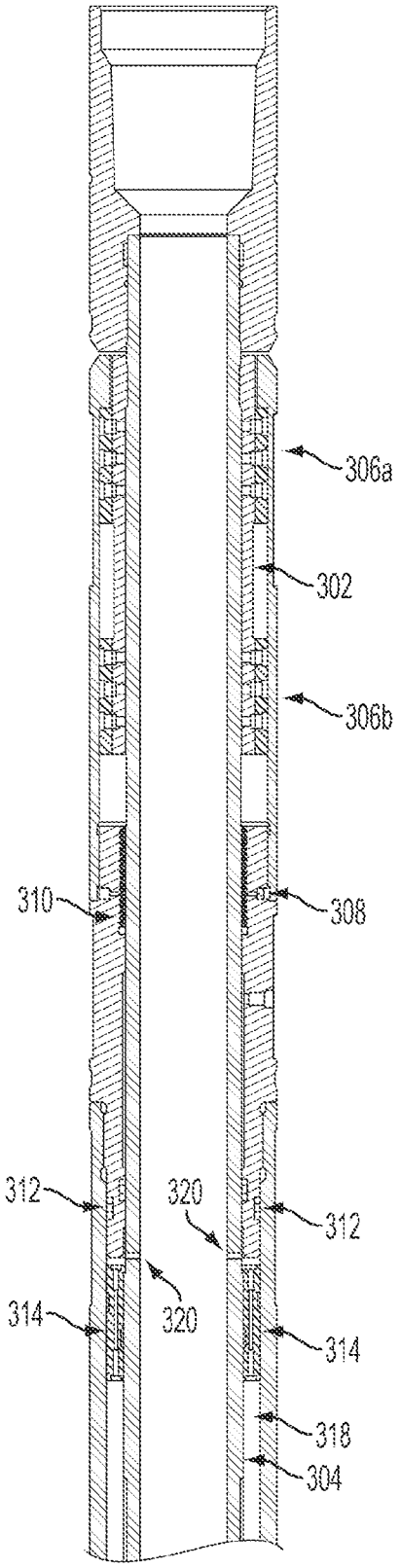
FIG. 3 is a cross-sectional view of a safety joint having a secondary retention mechanism according to one aspect of the present invention.

FIG. 3 is a cross-sectional view of a safety joint 202 having a secondary retention mechanism. The safety joint 202 can include shear pin assembly 302, a mandrel 304, a socket screw 308, a body lock ring 310, an o-ring 312, and a metering piston 314. The shear pin assembly 302 can include shear pin sets 306*a*, 306*b* that are the primary retention mechanism and secondary retention mechanism, respectively.

The shear pin assembly 302 can be coupled to the mandrel 304. The mandrel 304 can be an extendable shaft of the safety joint around which other components of the safety joint 202 are arranged or assembled. In some aspects, the shear pin set 306*a* can be threaded to the outside of the mandrel 304. Other tools and components can be positioned over the outer diameter of the shear pin set 306*a*. A shoulder of the outer portion of the shear pin set 306*a* can be threaded into the mandrel 304. The outer portion of the shear pin set 306*a* can exert a force resisting axial forces that can cause the mandrel 304 to extend axially, thereby preventing the actuation of the safety joint 202. An example of an axial force can include force exerted by the weight of the gun assembly 206.

The shear pin set 306*a* can be sheared prematurely or unintentionally during deployment of the tool string 114. For example, the shear pin set 306*a* can be sheared by a shock loading force generated by the operation of the gun assembly 206. The shear pin set 306*a* can also be sheared by pulling the tool string 114 with a force exceeding the shear strength of the shear pin set 306*a*.

Shearing the shear pin set 306*a* can cause the mandrel 304 to extend axially. The axial extension of the mandrel 304 can cause the loading of the shear pin set 306*b*. The loading of the shear pin set 306*b* can include the shear pin set 306*b* resisting the axial force causing the mandrel 304 to extend axially, thereby preventing additional axial extension of the mandrel 304.

The shear pin set 306*b* can be sheared intentionally, thereby causing the mandrel 304 to fully extend axially. For example, the shear pin set 306*b* can be sheared at a point in time after the deployment of the tool string 114 to a designated position in the tubing string 112. The socket screw 308 and the body lock ring 310 can prevent a fully extended mandrel 304 from collapsing. Additional or alternative aspects of the safety joint 202 can omit one or more of the socket screw 308 and/or the body lock ring 310.

The safety joint 202 can also include a time delay mechanism. The time delay mechanism can include any device or group of devices configured to generate a time delay between the shearing of a primary retention mechanism, such as the shear pin set 306*a*, and the loading of a secondary retention mechanism, such as the shear pin set 306*a*.

In some aspects, the time delay mechanism can restrict the flow of a metering fluid through the safety joint 202. Restricting the flow of metering fluid through the safety joint 202 can control the speed at which the mandrel 304 extends axially. Controlling the speed at which the mandrel 304 extends axially can generate the time delay between the shearing of the shear pin set 306*a* and the loading of the shear pin set 306*b*. The time delay can be greater than the duration of the application of the axial force shearing the shear pin set 306*a*. For example, a time delay can have a duration of several minutes and the application of the axial force shearing the shear pin set 306*a* and caused by the firing of the gun assembly 206 can have a duration of a few seconds. The time delay can thus prevent the shear pin set 306*b* from being sheared by the same force that shears the shear pin set 306*a*.

The time delay mechanism can include the o-ring 312 and the metering piston 314 depicted in FIG. 3. A chamber 318 adjacent to the metering piston 314 can be filled with a metering fluid or other fluid. The metering piston 314 and the o-ring 312 can apply an axial force against the metering fluid in chamber 318 causing the shear pin set 306*b* to move toward the shear pin set 306*a*, thereby resisting the axial force applied by the metering piston 314 and the o-ring 312. The movement of the shear pin set 306*b* toward the shear pin set 306*a* can be sufficiently slow that the duration of the movement is less than the duration of the force causing the shear pin set 306*a* to shear inadvertently.

Figure 4:
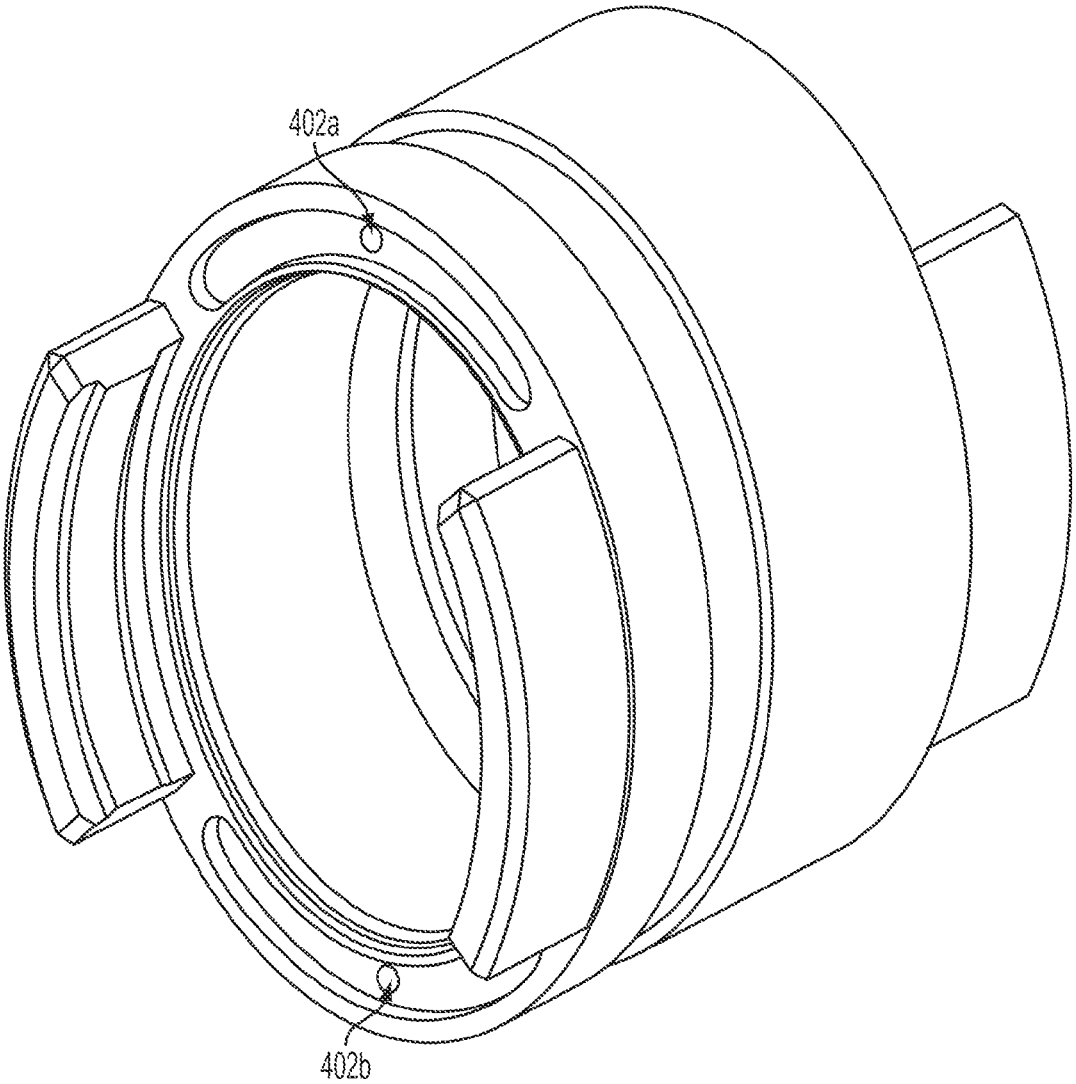
FIG. 4 is a perspective view of a metering piston of a safety joint having a secondary retention mechanism according to one aspect of the present invention.

The metering piston 314 can also include one or more check valves configured to cause the metering fluid to flow into the metering ports 320. The check valves can be inserted into drill gun holes through the piston, as depicted by the drill gun holes 402*a*, 402*b* in the perspective view of the metering piston 314 depicted in FIG. 4.

The metering ports 320 can restrict the flow of metering fluid through the safety joint 202. The movement of the metering piston 314 can be opposed by the metering fluid in the chamber 318. The metering piston 314 can move by forcing the metering fluid in the chamber 318 through the metering ports and into the inner diameter of the tool string 114. The restriction of the flow of metering fluid into the inner diameter by the metering ports 320 can generate a time delay by opposing the axial force applied by the metering piston 314.

In additional or alternate aspects, the time delay mechanism can include a rupture disc. An axial force can be applied to the safety joint 202. The movement of production fluid through the safety joint 202 can cause pressure to be applied to the rupture disc. The pressure applied to the rupture disc can cause the rupture disc to burst or otherwise rupture, thereby allowing the production fluid to flow into the inner diameter of the safety joint 202. The flow of fluid into the inner diameter of the safety joint 202 can cause allow the mandrel 304 to extend. The time delay mechanism can be configured to reduce the pressure on the rupture disc.

The safety joint 202 can allow all or part of the tool string 114 to be removed from the wellbore 102. For example, the gun assembly 206 can jam or otherwise become inoperable. A force can be applied to the safety joint 202 that is sufficient to shear the pins of the shear pin set 306*b*. The body of the safety joint can be decoupled from the gun assembly 206 via the application of torsion. For example, torsion can be applied by rotating the safety joint 202 having a fully extended mandrel 304. Right-hand rotation can be applied to decouple the body of the safety joint 202 from the gun assembly 206. A bypass in the safety joint 202 can cause the safety joint 202 to allow metering fluid to enter the inner diameter of the safety joint 202. The safety joint 202 and the tools of the tool string 114 coupled to the safety joint 202 can be retrieved from the wellbore via any suitable means.

The foregoing description of the aspects, including illustrated examples, of the invention has been presented only for the purpose of illustration and description and is not intended to be exhaustive or to limit the invention to the precise forms disclosed. Numerous modifications, adaptations, and uses thereof will be apparent to those skilled in the art without departing from the scope of this invention.

The invention claimed is:

1. An assembly including a safety joint configured to be disposed in a wellbore through a fluid-producing formation, the safety joint comprising:

a body configured to be disposed in the wellbore, the body movable between a first position and a second position;

a primary retention mechanism coupled to the body, the primary retention mechanism configured to be in a first state to prevent actuation of the safety joint and to be in a second state to allow the actuation of the safety joint;

a secondary retention mechanism coupled to the body, the secondary retention mechanism configured to be in a third state to prevent the actuation of the safety joint and to be in a fourth state to allow the actuation of the safety joint, the body being movable to the second position to place the secondary retention mechanism in the third state in response to the primary retention mechanism being in the second state; and a time delay mechanism configured to generate a time delay and prevent the safety joint from actuating during the time delay, the time delay being the time between the primary retention mechanism being in the second state and the body being movable to place the secondary retention mechanism in the third state.

2. The assembly of claim 1, wherein the body comprises an extendable mandrel and wherein each of the primary retention mechanism and the secondary retention mechanism is configured to prevent the actuation of the safety joint by preventing the extendable mandrel from extending in an axial direction.

3. The assembly of claim 2, wherein the primary retention mechanism comprises a first plurality of shear pins and the secondary retention mechanism comprises a second plurality of shear pins and wherein the first plurality of shear pins is configured to cease preventing the actuation of the safety joint in response to the shearing of the first plurality of shear pins.

4. The assembly of claim 1, wherein the time delay mechanism comprises:

a piston configured to apply an axial force to the secondary retention mechanism; and one or more ports configured to restrict a flow of fluid, wherein the fluid applies a second axial force resisting the axial force applied by the piston;

wherein the time delay corresponds to the rate of the flow of fluid.

5. The assembly of claim 1, further comprising:

a gun assembly configured to perforate a casing or a liner disposed in the wellbore, the body configured to be coupled to the gun assembly; and at least one additional tool configured to be coupled to the body.

6. The assembly of claim 5, wherein the body is configured to be decoupled from the gun assembly via the application of torsion and wherein the body and the at least one additional tool are configured to be retrieved from the wellbore.

7. The assembly of claim 5, wherein the time delay is greater than a duration of a perforating activity by the gun assembly.

8. A tool string configured to be disposed in a wellbore through a fluid-producing formation, the tool string comprising:

a gun assembly configured to perforate a casing or a liner disposed in the wellbore; and a safety joint comprising:

a body configured to be coupled to the gun assembly, the body movable between a first position and a second position;

a primary retention mechanism coupled to the body, the primary retention mechanism configured to be in a first state to prevent actuation of the safety joint and to be in a second state to allow the actuation of the safety joint;

a secondary retention mechanism coupled to the body, the secondary retention mechanism configured to be in a third state to prevent the actuation of the safety joint and to be in a fourth state to allow the actuation of the safety joint, the body being movable to the second position to place the secondary retention mechanism in the third state in response to the primary retention mechanism being in the second state; and a time delay mechanism configured to generate a time delay and prevent the safety joint from actuating during the time delay, the time delay being the time between the primary retention mechanism being in the second state and the body being movable to place the secondary retention mechanism in the third state, wherein the time delay is greater than a duration of a perforating activity by the gun assembly.

9. The tool string of claim 8, wherein the body of the safety joint comprises an extendable mandrel and wherein each of the primary retention mechanism and the secondary retention mechanism is configured to prevent the actuation of the safety joint by preventing the extendable mandrel from extending in an axial direction.

10. The tool string of claim 8, wherein the primary retention mechanism comprises a first plurality of shear pins and the secondary retention mechanism comprises a second plurality of shear pins.

11. The tool string of claim 8, wherein the time delay mechanism comprises:

a piston configured to apply an axial force to the secondary retention mechanism; and one or more ports configured to restrict a flow of fluid, wherein the fluid applies a force resisting the axial force applied by the piston;

wherein the time delay corresponds to the rate of the flow of fluid.

12. The tool string of claim 8, wherein the tool string comprises:

at least one additional tool configured to be coupled to the body, wherein the body is configured to be decoupled from the gun assembly via the application of torsion, and wherein the body and the at least one additional tool are configured to be retrieved from the wellbore.

13. A safety joint configured to be disposed in a wellbore through a fluid-producing formation, the safety joint comprising:

a body configured to be disposed in the wellbore, the body movable between a first position and a second position;

a first plurality of shear pins coupled to the body, the first plurality of shear pins configured to be in a first state to prevent actuation of the safety joint and to be in a second state to allow the actuation of the safety joint;

a second plurality of shear pins coupled to the body, the second plurality of shear pins configured to be in a third state to prevent the actuation of the safety joint and to be in a fourth state to allow the actuation of the safety joint, the body being movable to the second position to place the second plurality of shear pins in the third state in response to the first plurality of shear pins being in the second state; and a time delay mechanism configured to generate a time delay and prevent the safety joint from actuating during the time delay, the time delay being the time between the first plurality of shear pins being in the second state and the body being movable to place the second plurality of shear pins in the third state, wherein the time delay is greater than a duration of a perforating activity by the gun assembly.

14. The safety joint of claim 13, wherein the body comprises an extendable mandrel, wherein each of the first plurality of shear pins and the second plurality of shear pins is configured to prevent the actuation of the safety joint by preventing the extendable mandrel from extending in an axial direction.

15. The safety joint of claim 13, wherein the time delay mechanism comprises:

a piston configured to apply an axial force to the second plurality of shear pins; and one or more ports configured to restrict a flow of fluid, wherein the fluid applies a force resisting the axial force applied by the piston;

wherein the time delay corresponds to the rate of the flow of fluid.

16. The safety joint of claim 13, wherein the body is coupled to a tool string, a gun assembly configured to perforate a casing or a liner disposed in the wellbore and at least one additional tool.

17. The safety joint of claim 16, wherein the body is configured to be decoupled from the gun assembly via the application of torsion and wherein the body and the at least one additional tool are configured to be retrieved from the wellbore.

18. The safety joint of claim 16, wherein the time delay is greater than a duration of a perforating activity by the gun assembly.

* * * * *